US006250183B1

(12) United States Patent
Chiang

(10) Patent No.: US 6,250,183 B1
(45) Date of Patent: Jun. 26, 2001

(54) RATCHET TOOL HAVING VARIOUS TOOL MEMBERS

(76) Inventor: Shu Chi Chiang, No. 33-12, Lane 320, Sec. 1, Sa Tien Road, Da Du Hsiang, Taichung Hsien (TW)

( * ) Notice: Subject to any disclaimer, the term of this patent is extended or adjusted under 35 U.S.C. 154(b) by 0 days.

(21) Appl. No.: 09/500,952

(22) Filed: Jan. 15, 2000

(51) Int. Cl.[7] ..... B25B 13/46
(52) U.S. Cl. ..... 81/63.2; 81/63.1; 81/63
(58) Field of Search ..... 81/63.2, 63.1, 81/63; 408/122, 123; 470/184

(56) References Cited

U.S. PATENT DOCUMENTS 5,974,915 * 11/1999 Chou .
6,047,801 * 4/2000 Liao .
6,047,802 * 4/2000 Huang .
6,070,503 * 6/2000 Shiao .

* cited by examiner

*Primary Examiner*—Joseph J. Hail, III
*Assistant Examiner*—Willie Berry, Jr.
(74) *Attorney, Agent, or Firm*—Charles E. Baxley, Esq.

(57) ABSTRACT

A ratchet tool includes a cartridge having one end engaged in a handle and having an orifice for rotatably receiving a gear of a sleeve. One or more tool members may be engaged in the sleeve for driving various kinds of fasteners. A ratchet device is engaged in the cartridge for controlling the driving direction of the sleeve relative to the cartridge. A pair of pawls are slidably received in a pair of channels of the cartridge and are biased to engage with the gear. The gear may be selectively disengaged from the gear to control the driving direction of the sleeve.

7 Claims, 6 Drawing Sheets

RATCHET TOOL HAVING VARIOUS TOOL MEMBERS

BACKGROUND OF THE INVENTION

1. Field of the Invention

The present invention relates to a ratchet tool, and more particularly to a ratchet tool or a screw driver having various tool members.

2. Description of the Prior Art

A typical ratchet tool (ratchet screw driver) is disclosed in U.S. Pat. No. 5,685,204 to Braun and has a gear rotatably received in an insert and a pair of pawls biased to engage with the gear and selectively disengaged from the pawls by a control member. However, an additional control member is required for actuating and disengaging the pawls from the gear. In addition, the pawls may not be stably retained in place.

The present invention has arisen to mitigate and/or obviate the afore-described disadvantages of the conventional screw drivers.

SUMMARY OF THE INVENTION

The primary objective of the present invention is to provide a ratchet screw driver including a structure for allowing the driving stems to be changeably engaged with the screw driver handle, and including a pair of pawls that may be stably retained in place and that may be actuated by the control ferrule.

In accordance with one aspect of the invention, there is provided a ratchet tool comprising a handle including a first end, a cartridge including a first end engaged into the first end of the handle and rotated in concert with the handle, the cartridge having an orifice, a sleeve having a gear rotatably received in the orifice of the cartridge, the sleeve including a bore, a tool member engaged in the bore of the sleeve for engaging with and for driving fasteners, and a ratchet means for controlling a driving direction of the sleeve relative to the cartridge.

The cartridge includes a pair of channels communicating with the orifice of the cartridge, the ratchet means includes a pair of pawls slidably received in the channels of the cartridge and each having at least one tooth, means for biasing the tooth of the pawls to engage with the gear, and means for selectively disengaging the tooth of the pawls from the gear to control the driving direction of the sleeve.

The cartridge includes at least one slot formed therein, the biasing means includes a spring member received in the slot of the cartridge and engaged with the pawls respectively to bias the tooth of the pawls to engage with the gear. The cartridge includes a pair of notches formed therein and communicating the slot with the channels of the cartridge respectively, the spring member includes two spring legs extended inward of the channels of the cartridge to engage with the pawls via the notches of the cartridge.

The selectively disengaging means includes a control ferrule rotatably engaged on the cartridge, the control ferrule having an inner peripheral portion and having an actuator extended radially inward from the inner peripheral portion of the control ferrule for engaging with the pawls and for selectively disengaging the tooth of the pawls from the gear of the sleeve.

The control ferrule includes two depressions formed in the inner peripheral portion for defining the actuator and for receiving the pawls and for allowing the tooth of the pawls to be biased to engage with the gear of the driving stem.

A positioning device is further provided for positioning the control ferrule to the cartridge at a selected angular position and includes three cavities formed in the inner peripheral portion of the control ferrule, and a spring-biased projection received in the cartridge and selectively engaging with the cavities of the control ferrule to position the control ferrule to the cartridge at a selected angular position. The sleeve includes an annular swelling formed thereon and engaged with the control ferrule, and means for rotatably securing the sleeve to the cartridge.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
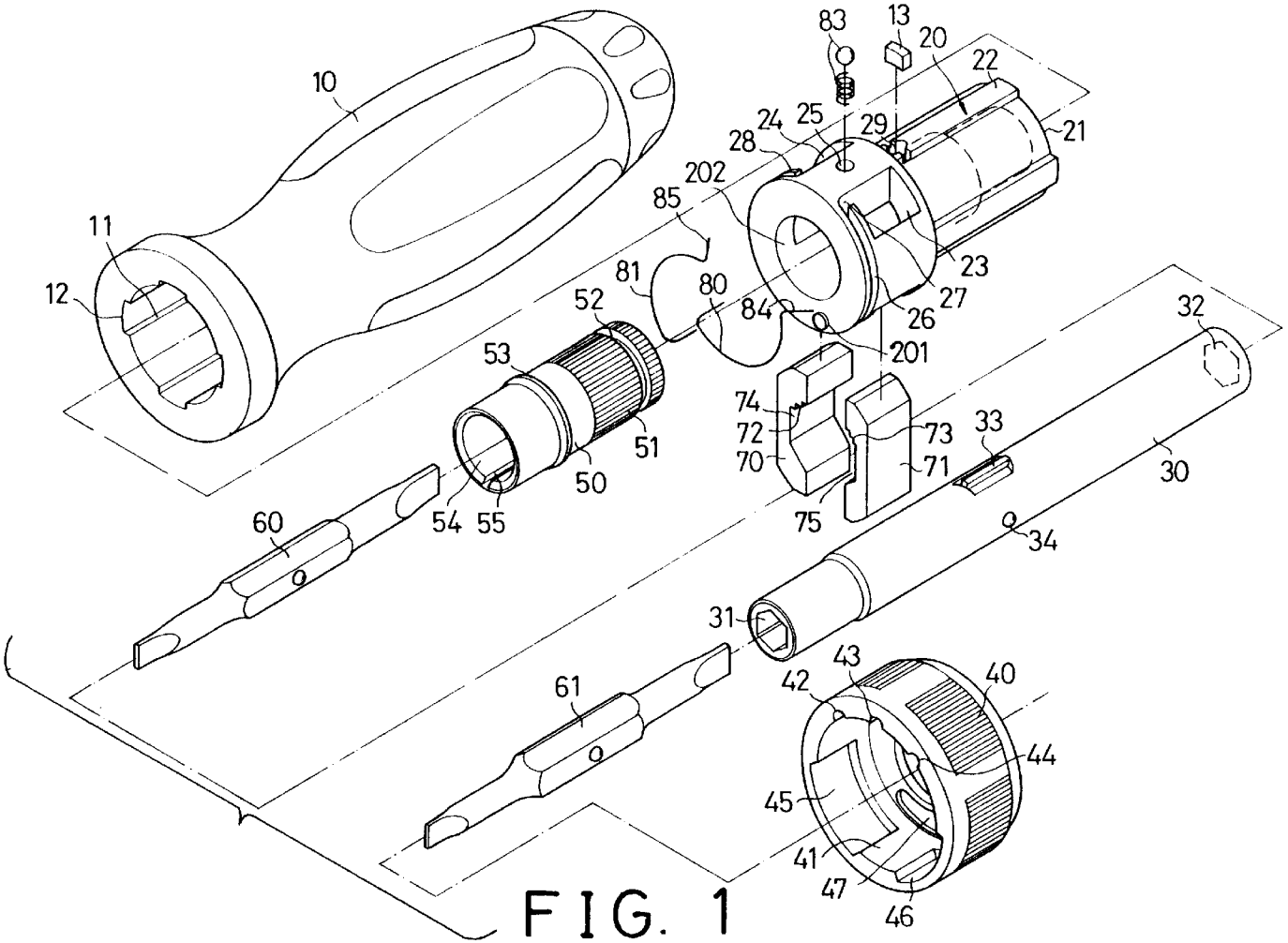
FIG. 1 is an exploded view of a ratchet tool in accordance with the present invention, as seen from the top of the ratchet tool, for example.

Referring to the drawings, and initially to FIGS. 1–5, a ratchet tool in accordance with the present invention comprises a handle 10 including a bore 11 one or more grooves 12 formed in one end thereof and communicating with each other. A cartridge 20 includes a stud 21 extended from one end thereof and engaged into the bore 11 of the handle 10 and includes one or more ribs 22 extended from the stud 21 for engaging with the grooves 12 of the handle 10 and for securing the cartridge 20 to the handle 10 and for preventing the cartridge 20 from rotating relative to the handle 10. A sleeve 50 is rotatably received in an orifice 202 of the cartridge 20 and has a gear 51 formed thereon, particularly formed on one end thereof, and includes a swelling, such as a peripheral swelling 53 extended therefrom, and includes an annular groove 52 formed therein. A key 13 is engaged through a hole 29 that is formed in the cartridge 20 and engaged in the annular groove 52, of the sleeve 50 for rotatably securing the sleeve 50 in the cartridge 20. The cartridge 20 includes a stop 201 extended therefrom opposite to the stud 21. The sleeve 50 includes a bore 54 formed therein for slidably receiving a barrel 30 and includes one or more slots 55 formed therein and communicating with the bore 54 of the sleeve 50.

The cartridge 20 includes two parallel channels 23, 24 formed in the cartridge 20 and communicating with the orifice 202 for slidably receiving a pair of pawls 70, 71 respectively, and includes a cave 25 formed therein for receiving a spring-biased projection 83. The pawls 70, 71 each has one or more teeth 72, 73 for engaging with the gear 51 and each has a depression 74, 75 formed therein for rotatably receiving the gear 51. The cartridge 20 includes one or more slots 26, 28 formed therein for receiving one or more springs 80, 81 and includes a pair of notches 27 communicating the slots 26, 28 with the respective channels 23, 24. The springs 80, 81 each includes a leg 84, 85 extended into the respective channels 23, 24 via the notches 27 respectively and engaged with the pawls 70, 71 (FIGS. 3, 4) for biasing the teeth 72, 73 to engage with the gear 51.

Figure 2:
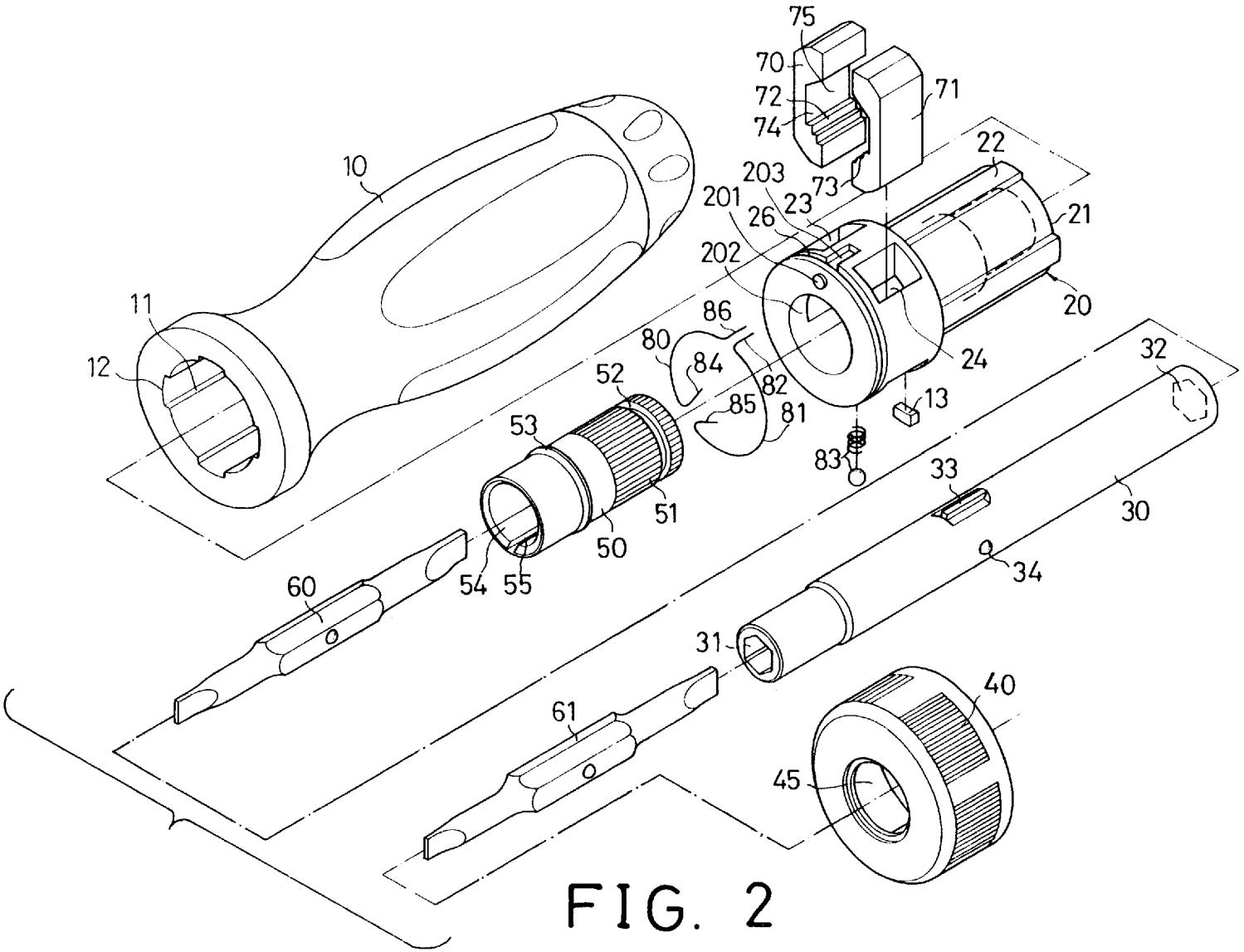
FIG. 2 is an exploded view of the ratchet tool, as seen from the bottom of the ratchet tool, for example.
Figure 3:
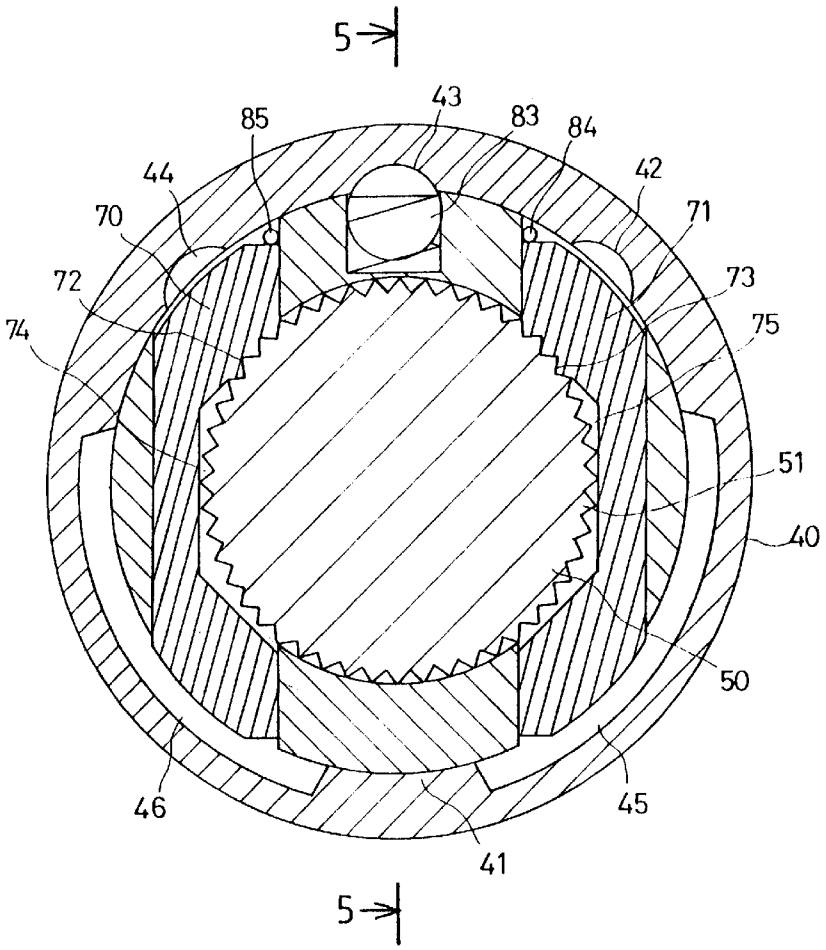
FIG. 3 is a cross sectional view taken along lines 3—3 of FIG. 5.
Figure 4:
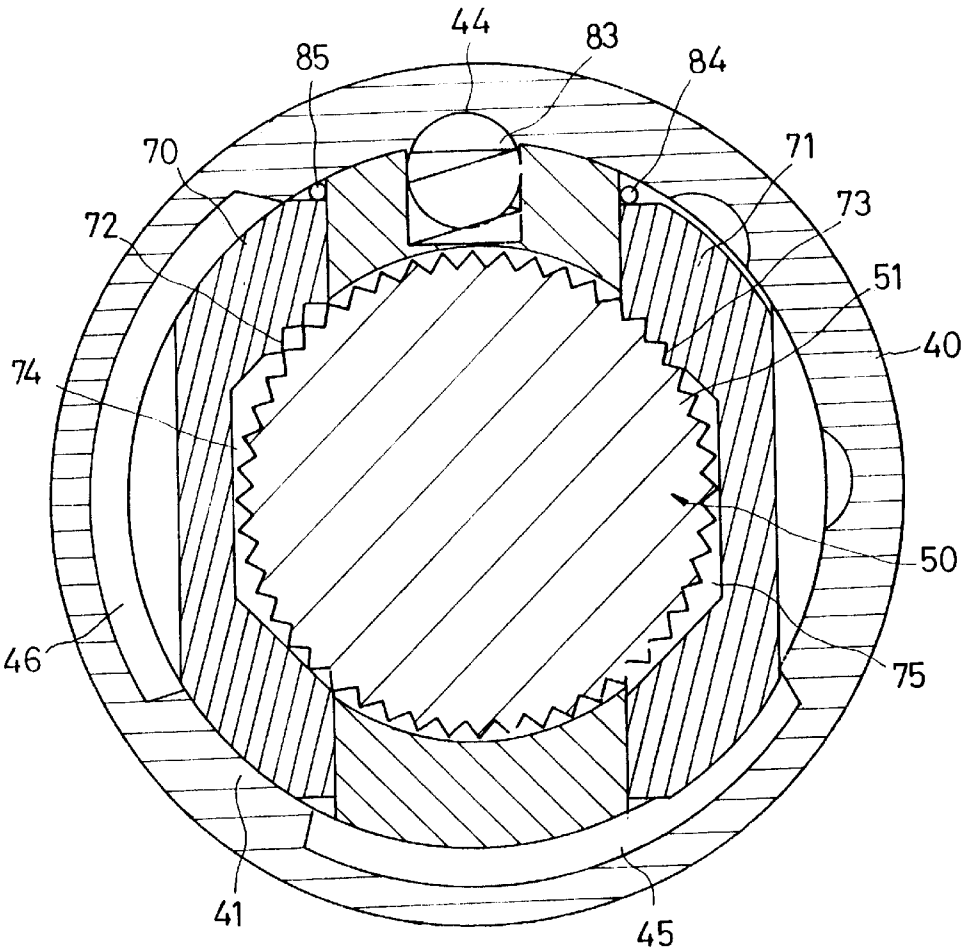
FIG. 4 is a cross sectional view similar to FIG. 3, illustrating the operation of the ratchet tool.
Figure 5:
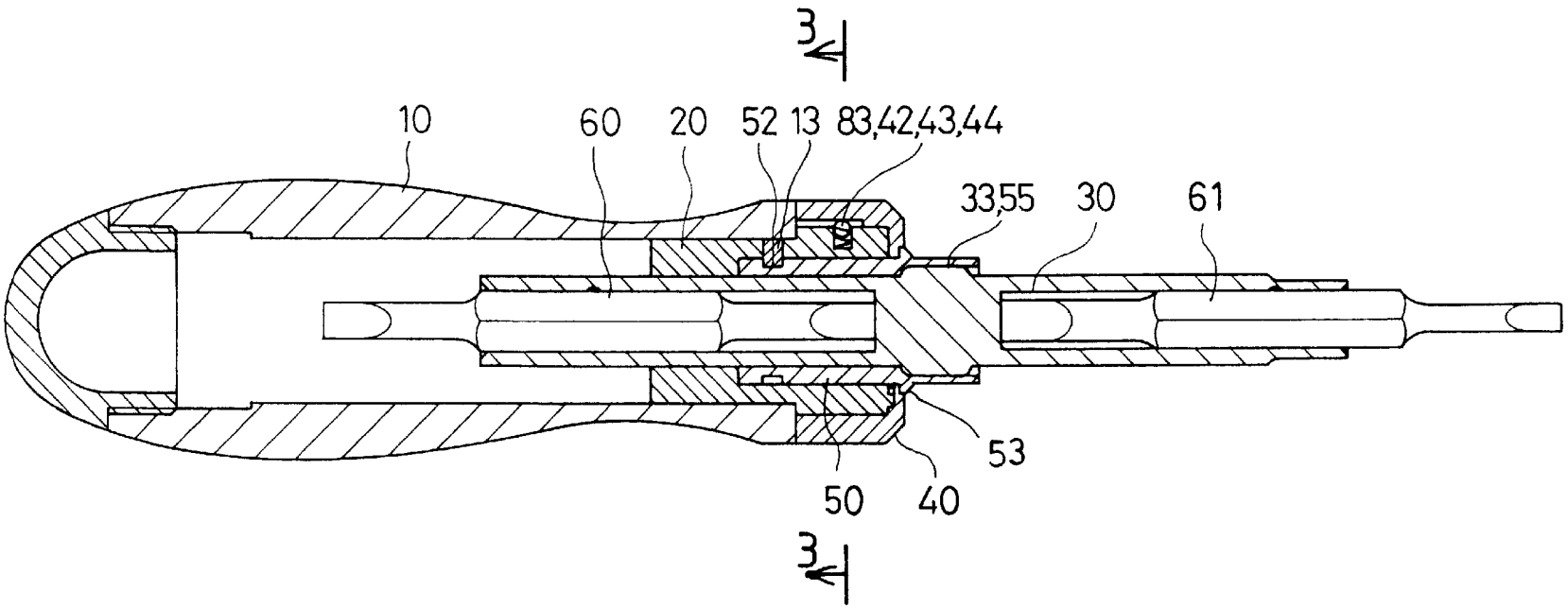
FIG. 5 is a cross sectional view taken along lines 5—5 of FIG. 3.

As shown in FIGS. 3 and 4, it is only required to form the teeth 72, 73 in one end of the respective pawls 70, 71. However, the teeth 72, 73 may also be formed in both ends of the pawls 70, 71, such that, when the teeth 72, 73 in one end of the pawls 70, 71 are worn out, the pawls 70, 71 may be changed to different direction for allowing the other teeth 77, 78 to be biased to engage with the gear 51 by the springs 80, 81 respectively. As shown in FIG. 2, the other ends 82, 86 of the springs 80, 81 may be engaged in the cave 203 formed in the cartridge 20 opposite to the spring-biasing projection 83 and may be secured to the cartridge 20. Alternatively, the ends 82, 86 of the springs 80, 81 may be secured together or formed as an integral piece for forming a single spring having two legs 84, 85 to engage with the pawls 70, 71.

A control ferrule 40 is rotatably secured onto the cartridge 20 and includes a curved groove 47 formed therein for slidably receiving the stop 201 of the cartridge 20 and for limiting the rotational movement of the control ferrule 40 relative to the cartridge 20. The peripheral swelling 53 of the sleeve 50 is engaged with the control ferrule 40 (FIGS. 5, 6) for securing the control ferrule 40 to the cartridge 20. The control ferrule 40 includes an inner peripheral portion having three cavities 42, 43, 44 for receiving the spring-biased projection 83 which may position the control ferrule 40 relative to the cartridge 20 at the selected angular position (FIGS. 3, 4). The control ferrule 40 has an actuator 41 extended radially inward from the inner peripheral portion thereof and preferably formed between two recesses 45, 46 which may receive the pawls 70, 71 (FIGS. 3, 4). The actuator 41 may move the pawls 70, 71 against the spring leg 84, 85 for disengaging the teeth 72, 73 of the pawls 70, 71 from the gear 51 (FIG. 4), and for controlling the driving direction of the ratchet tool.

Figure 6:
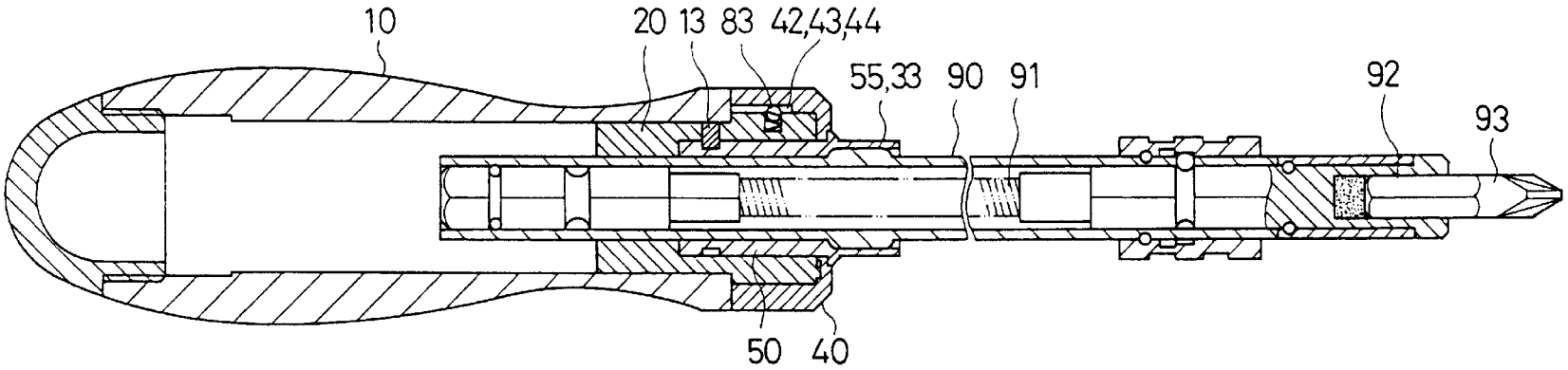
FIG. 6 is a cross sectional view similar to FIG. 5, illustrating the other application of the ratchet tool.

A barrel 30 is engageable into the sleeve 50 and has one or more ears 33 engaged in the slots 55 of the sleeve 50 and has one or more spring-biased projections 34 engaged with the sleeve 50 to position the barrel 30 to the sleeve 50 and for preventing the barrel 30 from rotating relative to the sleeve 50. The barrel 30 has two end holes 31, 32 formed therein for receiving tool members 60, 61 therein respectively. The tool members 60, 61 each has two bits formed on the ends (FIGS. 1, 2 and 5) such that four tool bits may be included in one of the barrels 30. As shown in FIG. 6, the other type of barrel 90 may also be engaged in the sleeve 50 for receiving a flexible tool member 91 which has a hole 92 formed in each end for receiving the tool bit 93. The ratchet tool thus may each include various kinds of tool members or tool bits therein.

In operation, when the actuator 41 of the control ferrule 40 is disengaged from the pawls 70, 71, as shown in FIG. 3, the pawls 70, 71 may be received in the depressions 45, 46 of the control ferrule 40 respectively and the teeth 72, 73 of the pawls 70, 71 are biased to engage with the gear 51, such that the gear 51 and thus the driving stem 30 may be driven to rotate in both directions by the handle 10 via the cartridge 20. As shown in FIG. 4, when the control ferrule 40 is rotated in one direction to actuate the actuator 41 thereof to force and to move the pawl 70 against the spring leg 85 and to disengage the teeth 72 of the pawl 70 from the gear 51, the gear 51 and thus the driving stem 30 may be driven to rotate in the counterclockwise direction by the handle 10 via the cartridge 20 and may not be rotated in the clockwise direction by the handle 10. When the control ferrule 40 is rotated in the reverse direction to cause the actuator 41 thereof to disengage the teeth 73 of the other pawl 71 from the gear 51, the driving stem 30 may be driven to rotate in the clockwise direction.

It is to be noted that the pawls 70, 71 are stably and slidably retained in the channels 23, 24 of the cartridge 20 and may be solidly retained in place in the cartridge 20. It is preferable that the channels 23, 24 of the cartridge 20 and the pawls 70, 71 slidably engaged in the channels 23, 24 of the cartridge 20 include a sliding and guiding key-and-groove device; or, the pawls 70, 71 and the channels 23, 24 of the cartridge 20 each includes a non-circular cross section, for guiding the pawls 70, 71 to slide along the channels 23, 24 of the cartridge 20 and for preventing the pawls 70, 71 from rotating relative to the cartridge 20. The pawls 70, 71 may be directly actuated by the actuator 41 of the control ferrule 40 such that the elements are reduced and the configuration and the cost thereof may be reduced.

Accordingly, the ratchet tool in accordance with the present invention includes a structure for allowing various kinds of driving stems to be changeably engaged with the screw driver handle, and includes a pair of pawls that may be stably retained in place and that may be actuated by the control ferrule.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a handle including a first end, a cartridge including a first end engaged into said first end of said handle and rotated in concert with said handle, said cartridge including an orifice formed therein, said cartridge including a pair of channels formed therein and communicating with said orifice of said cartridge, said cartridge including at least one slot formed therein, a sleeve including a gear rotatably received in said orifice of said cartridge, said sleeve including a bore formed therein, a tool member engaged in said bore of said sleeve for engaging with and for driving fasteners, and a ratchet means for controlling a driving direction of said sleeve relative to said cartridge, said ratchet means including a pair of pawls slidably received in said channels of said cartridge respectively and each having at least one tooth formed thereon, means for biasing said at least one tooth of said pawls to engage with said gear, and means for selectively disengaging said at least one tooth of said pawls from said gear to control a driving direction of said sleeve relative to said cartridge, said biasing means including a spring member received in said at least one slot of said cartridge and engaged with said pawls respectively to bias said at least one tooth of said pawls to engage with said gear.

2. The ratchet tool according to claim 1, wherein said cartridge includes a pair of notches formed therein and communicating said at least one slot with said channels of said cartridge respectively, said spring member includes two spring legs extended inward of said channels of said cartridge to engage with said pawls via said notches of said cartridge.

3. The ratchet tool according to claim 1, wherein said selectively disengaging means includes a control ferrule rotatably engaged on said cartridge, said control ferrule having an inner peripheral portion and having an actuator extended radially inward from said inner peripheral portion of said control ferrule for engaging with said pawls and for selectively disengaging said at least one tooth of said pawls from said gear of said sleeve.

4. A ratchet tool comprising:

a handle including a first end, a cartridge including a first end engaged into said first end of said handle and rotated in concert with said handle, said cartridge including an orifice formed therein, said cartridge including a pair of channels formed therein and communicating with said orifice of said cartridge, a sleeve including a gear rotatable received in said orifice of said cartridge, said sleeve including a bore formed therein, a tool member engaged in said bore of said sleeve for engaging with and for driving fasteners, and a ratchet means for controlling a driving direction of said sleeve relative to said cartridge, said ratchet means including a pair of pawls slidably received in said channels of said cartridge respectively and each having at least one tooth formed thereon, means for biasing said at least one tooth of said pawls to engage with said gear, and means for selectively disengaging said at least one tooth of said pawls from said gear to control a driving direction of said sleeve relative to said cartridge, said selectively disengaging means including a control ferrule rotatable engaged on said cartridge, said control ferrule having an inner peripheral portion and having an actuator extended radially inward from said inner peripheral portion of said control ferrule for engaging with said pawls and for selectively disengaging said at least one tooth of said pawls from said gear of said sleeve, said control ferrule including two depressions formed in said inner peripheral portion thereof for defining said actuator, said depressions of said control ferrule being provided for receiving said pawls and for allowing said at least one tooth of said pawls to be biased to engage with said gear of said driving stem.

5. A ratchet tool comprising:

a handle including a first end, a cartridge including a first end engaged into said first end of said handle and rotated in concert with said handle, said cartridge including an orifice formed therein, said cartridge including a pair of channels formed therein and communicating with said orifice of said cartridge, a sleeve including a gear rotatable received in said orifice of said cartridge, said sleeve including a bore formed therein, a tool member engaged in said bore of said sleeve for engaging with and for driving fasteners, a ratchet means for controlling a driving direction of said sleeve relative to said cartridge, said ratchet means including a pair of pawls slidably received in said channels of said cartridge respectively and each having at least one tooth formed thereon, means for biasing said at least one tooth of said pawls to engage with said gear, and means for selectively disengaging said at least one tooth of said bawls from said gear to control a driving direction of said sleeve relative to said cartridge, said selectively disengaging means including a control ferrule rotatable engaged on said cartridge, said control ferrule having an inner peripheral portion and having an actuator extended radially inward from said inner peripheral portion of said control ferrule for engaging with said bawls and for selectively disengaging said at least one tooth of said pawls from said gear of said sleeve, and means for positioning said control ferrule to said cartridge at a selected angular position.

6. The ratchet tool according to claim 5, wherein said positioning means includes three cavities formed in said inner peripheral portion of said control ferrule, and a spring-biased projection received in said cartridge and selectively engaging with said cavities of said control ferrule to position said control ferrule to said cartridge at a selected angular position.

7. A ratchet tool comprising:

a handle including a first end, a cartridge including a first end engaged into said first end of said handle and rotated in concert with said handle, said cartridge including an orifice formed therein, said cartridge including a pair of channels formed therein and communicating with said orifice of said cartridge, a sleeve including a gear rotatable received in said orifice of said cartridge, said sleeve including a bore formed therein, a tool member engaged in said bore of said sleeve for engaging with and for driving fasteners, a ratchet means for controlling a driving direction of said sleeve relative to said cartridge, said ratchet means including a pair of pawls slidably received in said channels of said cartridge respectively and each having at least one tooth formed thereon, means for biasing said at least one tooth of said pawls to engage with said gear, and means for selectively disengaging said at least one tooth of said pawls from said gear to control a driving direction of said sleeve relative to said cartridge, said selectively disengaging means including a control ferrule rotatable engaged on said cartridge, said control ferrule having an inner peripheral portion and having an actuator extended radially inward from said inner peripheral portion of said control ferrule for engaging with said pawls and for selectively disengaging said at least one tooth of said pawls from said gear of said sleeve, said sleeve including an annular swelling formed thereon and engaged with said control ferrule, and means for rotatably securing said sleeve to said cartridge.

* * * * *